United States Patent [19]

Sisko

[11] Patent Number: 4,893,606

[45] Date of Patent: Jan. 16, 1990

[54] DISTRIBUTED MASS, INERTIAL ARCHERY BOW STABILIZER AND VIBRATION DAMPER

[76] Inventor: Frank W. Sisko, 159 Elkin Ave., Indiana, Pa. 15701

[21] Appl. No.: 233,807

[22] Filed: Aug. 19, 1988

[51] Int. Cl.[4] ..... F41B 5/00

[52] U.S. Cl. ..... 124/89; 188/378

[58] Field of Search ..... 124/23 R, 24 R, 86, 124/88, 89; 188/378; 267/136, 137

[56] References Cited

U.S. PATENT DOCUMENTS

| | | | |
|---|---|---|---|
| 3,412,725 | 11/1968 | Hoyt | 124/89 X |
| 3,670,712 | 6/1972 | Izuta | 124/89 |
| 3,683,883 | 8/1972 | Izuta | 124/89 |
| 4,150,819 | 4/1979 | Taylor | 267/136 |
| 4,245,612 | 1/1981 | Finlay | 124/89 |
| 4,570,608 | 2/1986 | Masterfield | 124/89 |

FOREIGN PATENT DOCUMENTS

| | | | |
|---|---|---|---|
| 1296201 | 11/1972 | United Kingdom | 124/89 |

*Primary Examiner*—Dennis L. Taylor

*Assistant Examiner*—John Ricci

*Attorney, Agent, or Firm*—George C. Atwell

[57] ABSTRACT

The invention disclosed utilizes distributed mass in an inertial archery bow stabilizer and vibration damper. It employs internal flow limiting structure and a high density fluid inertial mass. The device comprises two major subassemblies. The first subassembly is a stabilizing element which includes an elongated casing plugged at each end, and having therein the flow limiting structure, preferably in the form of baffles, and fluid to provide the arrow release stabilization and vibration damping effect, the latter being influenced in its action by the presence and design of the baffles. The second subassembly is a housing which holds the first subassembly and preferably comprises a rigid tube or outer housing, end plugs, mounting structure at one end of the tube, and a cushioning bushing. The thrust stabilization is achieved by the relatively large mass of high density fluid retained within the rigid tube enclosing the stabilizing subassembly. Vibration damping is achieved by movement of fluid through and around the flow limiting structure within the casing.

11 Claims, 3 Drawing Sheets

DISTRIBUTED MASS, INERTIAL ARCHERY BOW STABILIZER AND VIBRATION DAMPER

BACKGROUND OF THE INVENTION

The invention relates to archery bows for hunting and target applications, and more particularly to a stabilizer and vibration damper adapted to remove bow thrust and torque which occurs due to involuntary muscle contraction while the archer is holding the bow in a drawn highly tensed state and due to shock when the arms of the bow return to rest after the arrow is released. The thrust, torque and shock affects the arrow's cast, significantly reducing shooting accuracy.

Archers have long tried to improve the accuracy of the bow by employing various types of stabilizers and vibration dampers designed to remove vibration during sighting and after arrow release and to reduce the shock imparted to the handle of the bow by the springing bow arms. Refer to examples of prior art in U.S. Pat. Nos. 3,589,350, 3,628,520, 3,670,712, 4,245,612, 4,570,608, 4,615,327, and 4,660,538. Most have used concentrated weight at the end of a relatively long rod attached either to the upper, the lower, or to both the upper and lower ends of the bow handle. Some have been rigidly mounted, some resiliently mounted. Some use rubber-like resilient dampers, others use viscous fluid coupling the bow handle to the weighted rod. Although such prior art devices have undoubtedly improved the accuracy of a bow, the invention disclosed here greatly enhances bow stabilization and vibration reduction through implementation of certain unique engineering concepts.

One very recent contribution to the art comprises an elongated tubular housing, closed at both ends and having a mounting stud at one end, and carrying within its sealed chamber an elongated cylindrical metal slug extending approximately half the length of the chamber. The slug is carried toward the outer end of the unit between cushioning compression springs, and toward the mounting end is a flat washer also carried between compression springs. Also carried within the chamber is a substantial amount of fluid having the general viscosity of automotive brake fluid. The outside diameter of the washer is slightly less than the inside diameter of the chamber, and the outside diameter of the cylindrical slug is slightly less than the washer. The washer acts as an inhibitor to the shifting flow of the fluid and the cylindrical slug at the forward end serves as a means of absorbing the energy of vibration and thrust during use of the bow to which the unit is mounted. This use of a shiftable solid mass in a fluid bed appears to have significant advantages over stabilizers introduced prior to it, however, experimentation has shown that performance characteristics in a stabilizer can even be more greatly enhanced by distributing comparable mass the entire length of a stabilizer casing as comprehended in the present invention.

SUMMARY OF THE INVENTION

A primary objective of this invention is to provide improved stability by substituting a distributed mass for the concentrated mass used in prior art. Improved stability is obtained because a larger mass is distributed within the stabilizing subassembly of this invention than is concentrated in other art. Mercury is the liquid chosen for the preferred embodiment of the invention because it has a density of approximately 13 times that of water, permitting much less mercury to be used than would be possible using other media.

A second primary objective of this invention is to provide improved vibration damping by substituting a high density, high surface tension, low viscosity liquid for the viscous liquid used in other art. Vibrations are more effectively damped because the liquid is forced to move through and around flow restrictors which have been bored to contain edge orifices and which are located within the stabilizing subassembly. Since the motion of the liquid is restricted, harmonic energy is dissipated as losses in the flow restrictors. Mercury has been chosen as the fluid or the preferred embodiment of the invention for this purpose.

Another objective of the invention is to provide, in a bow stabilizer, a stabilizing subassembly to perform the stabilizing and vibration damping actions.

Another objective of the invention is to provide, in a bow stabilizer, a housing to hold and protect the stabilizing subassembly and to provide for a rigid connection to mate the stabilizer to the bow.

In one presently preferred form, the structure of the invention is an elongated casing, sealed at its ends, and defining a central chamber. The casing is preferably secured in a protective outer housing which has means at one end to enable the entire unit or stabilizer to be mounted at the appropriate point on the face side of an archer's bow whereby it projects forwardly from the bow generally in the direction an arrow is to be cast. Within the chamber is contained a flowable material, preferably mercury, which occupies less than the full space of the chamber whereby the material is free to flowably shift within the casing. A flow restricting means, such as baffles, is contained within the chamber, preferably comprising a plurality of spaced-apart sleeve-like members adapted to permit the mercury, in shifting, to flow through and around the body of the member. A means is provided within the chamber, which may be a plurality of relatively light-duty compression springs, to retain the baffles or tubular members generally at predetermined positions within the chamber. Means may be provided on one or more of the baffles to restrict or influence the shifting flow of the mercury.

The operation of the disclosed stabilizer structure, along with contemplated variations in the structure, and certain of the stabilizer's features and characteristics, will be understood and appreciated from the ensuing detailed description.

DESCRIPTION OF THE PREFERRED EMBODIMENT

Figures 1, 2:
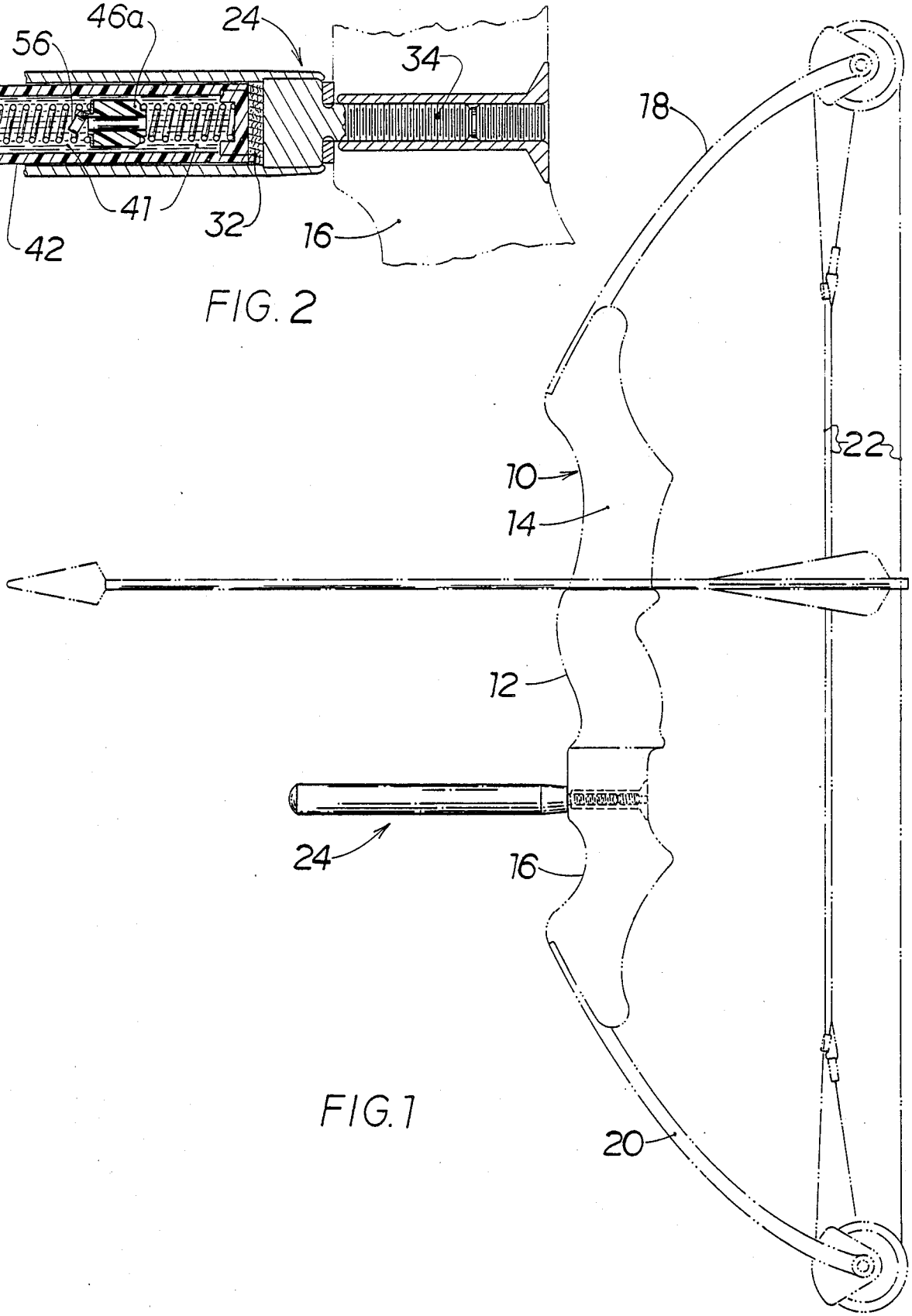
FIG. 1 is a side elevation view of a conventional archery bow showing the stabilizer housing of the present invention mounted into the lower handle of an archery bow.
FIG. 2 is a partially sectioned view of the stabilizer mounting first shown in FIG. 1, illustrating a method of mounting the stabilizer onto the bow handle.

Directing attention to FIG. 1, the numeral 10 generally designates the archery bow. The bow 10 includes a handle 12 and handle portions 14 and 16, upper limb or arm 18, lower limb or arm 20, and string 22. The string 22 connects the upper limb 18 to the lower limb 20. The stabilizer 24 is threaded into the lower handle portion 16 of the bow 10 to provide a rigid connection thereto.

FIG. 2 generally illustrates a method for mounting the stabilizer 24 to the lower bow handle handle 16. The method shown is illustrative only. Any sound method of rigidly connecting the stabilizer to the bow is acceptable.

Figure 3:
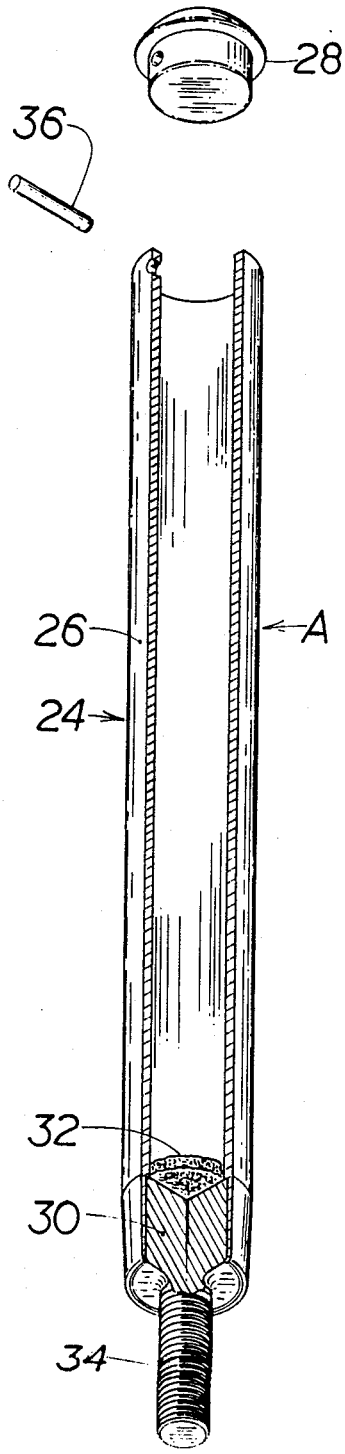
FIG. 3 is a partially sectioned view of the stabilizer housing first shown in FIG. 1, here illustrating certain preferred components of the housing.
Figure 4:
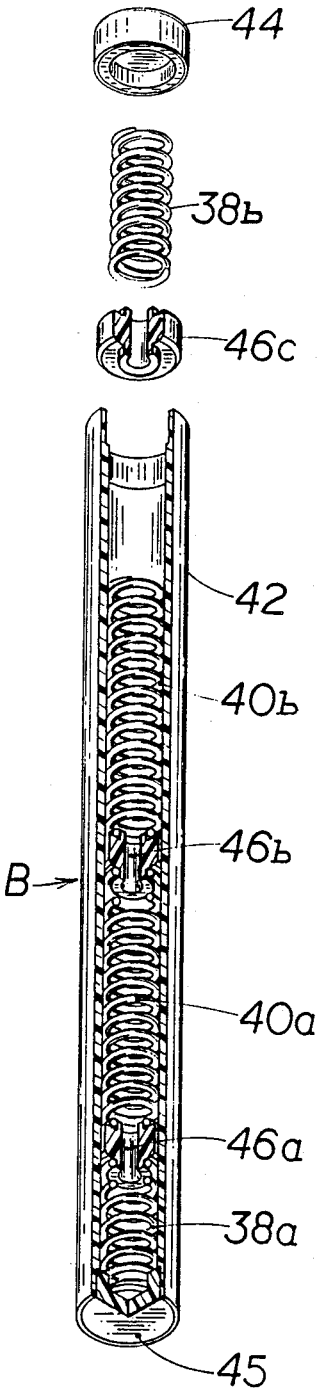
FIG. 4 is a partially sectioned view of the stabilizing subassembly of the stabilizer first shown in FIG. 1, and showing certain components of this subassembly.
Figure 5:
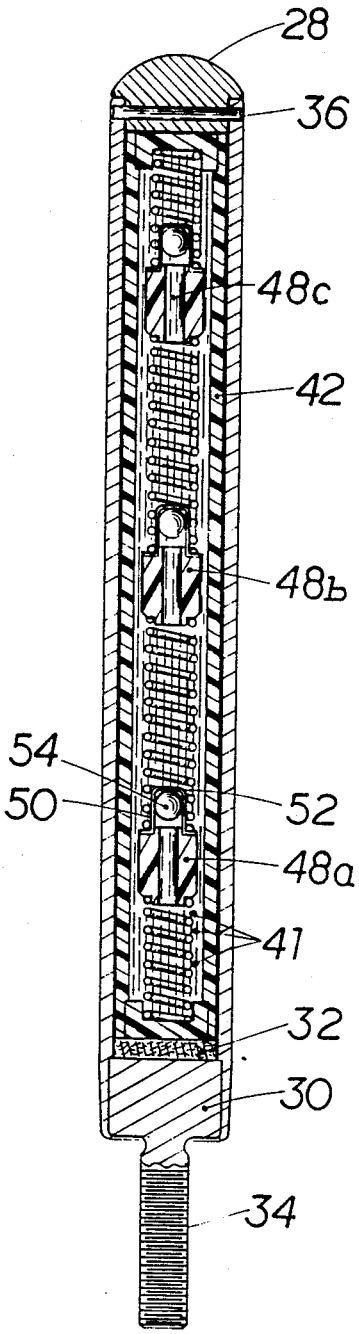
FIG. 5 is a partially sectioned view of the stabilizer showing the major subassemblies of the invention and indicating the presence of a fluid stabilizing and vibration damping material.

The structural details of the stabilizer are shown in FIGS. 3, 4, and 5. FIG. 3 generally illustrates a cylinder 26 of the housing 24 with end plugs 28 and 30, a bushing 32 and threaded mounting stud 34, all comprising a subassembly A. The hollow cylinder 26 is preferably fabricated from aluminum tubing. It has an inside diameter of sufficient size to provide a loose sliding fit for a stabilizing subassembly B (FIG. 4) and an outside diameter calculated to provide sufficient rigidity to protect the stabilizing subassembly from damage during any foreseeable circumstance.

The end caps 28 and 30 may be fabricated from either metal or plastic. The forward end cap 28 has two diameters. The smaller diameter exists for most of its length and is sufficient so that it may be forced into the forward end of the cylinder 26 with an interference fit. A drive pin 36 is illustrative of a method to lock the end cap 28 in place, as best shown in FIG. 5. The smaller diameter of end cap 28 shoulders out near the front to a larger diameter which equals the outside diameter of the housing cylinder 26. The outer end of the forward end cap 28 has a spherical shape with a large radius whereby, in its installed position, its annular edge merges smoothly with the end of the tube 26.

The rear end plug 30 has a diameter sufficient so that it may be forced into the rearward end of the cylinder 26 with an interference fit. The rear of the cylinder 26 is preferably swaged over the end of the plug 30 to lock it into place although other means of fixing the plug in the tube would be acceptable. A threaded stud 34 is either formed as part of the plug or staked into the rear plug 30. The stud 34 rigidly attaches the stabilizer 24 to the bow 10. A washer 32 is inserted in the cylinder 26 over the rear plug 30 to cushion and protect the stabilizing subassembly B from damage and to fix the axial location of the stabilizing subassembly within the housing subassembly A.

FIG. 4 illustrates generally the inertial stabilizing and vibration damping subassembly B and shows that this subassembly embodies a means of containing the stabilizing fluid and flow restrictors having appropriate bidirectional flow capacities. All components in the preferred embodiment of the subassembly B are preferably formed from a plastic material such as polyvinyl chloride (PVC), except helical compression springs 38*a*, 38*b*, 40*a*, and 40*b*, and the stabilizing and vibration damping material, which is preferably mercury 41 (FIG. 5). The subassembly B has a casing or tube 42 which is machined to accept sealing plugs 44 and 45 at its respective ends. The sealing plugs 44 and 45 prevent the mercury 41 from escaping from the subassembly B and act as bearing surfaces for the helical springs 38 and 40.

Contained within the tube 42 is a flow limiting or restricting means, its presently preferred form being a plurality of spaced-apart baffles 46*a*, 46*b*, and 46*c*. The baffles 46*a*, 46*b*, and 46*c* are made from sections of rod which are bored axially through the center forming an edge-type orifice. The baffles restrict the free movement of the mercury 48, causing a damping effect on the vibration present in the bow 10. The baffles 46 are fixed in their locations within the tube 42 by the springs 38 and 40. The springs 38*a*, 38*b*, 40*a*, and 40*b* serve to return the baffles to their original position after slight shifting due to movement of the mercury 41.

The springs 38*a* and 38*b* are matched pairs, as are 40*a* and 40*b*. The springs 38*a* and 38*b* are of length L1 and the springs 40*a* and 40*b* are of length L2 where L2=2L1. The shorter springs 38*a* and 38*b*, length L1, bear on the end caps 44 of the inertial subassembly at one spring end and on the adjacent baffle at the other spring end. The longer springs 40*a* and 40*b*, length L2, bear on the insides of the outer baffles 46*a* and 46*c*, and on the center baffle 46*b*. The springs are sized to return the baffles to their normal rest position after a dislocation caused by the movement of the mercury 41. Mercury 41 is contained within the tube 42, preferably filling between 80 and 90 percent of the free volume of the tube. The free space remaining permits the motion of the mercury 41 to act as a vibration damping element. The mass of the mercury 41 acts as a stabilizing element, reducing the magnitude of thrust dissipated in the bow handle (FIG. 1).

FIG. 5 shows how the two subassemblies A and B generally appear when united into the full stabilizer structure. FIG. 5 also illustrates a modified alternative form for the flow restricting or limiting means within the casing 42. Whereas, the flow limiting means shown in FIG. 4 comprises a series of spaced-apart baffles having an axial or through-bore to permit the mercury 41 to move through the baffles in either direction, the flow limiting means in FIG. 5 permits movement of the mercury 41 relative to the baffles in the forward direction away from the bow, toward the end cap 28, at a preestablished rate, but substantially restricts the flow of mercury in the rearward or return direction toward the stud 34.

Specifically, the mercury 41 in the casing 42, particularly as shown in FIG. 5, can shift forwardly by flowing around the baffles and also centrally through the baffles. A self-closing valve is provided on each of the baffles whereby return flow centrally through each baffle is prevented, although circumjacent flow past the outer surface of each baffle is unimpeded. Baffle 48*a* is representative of the construction of all of the baffles shown in FIG. 5 and includes an attached valve assembly 50 having a cage 52 with a ball 54 captured within it. During forward thrust, the ball moves to the open position shown whereby mercury can move through the central passage of each baffle, but return flow causes the ball to seal across the central opening of the baffle whereby any flow past the baffle must be around it rather than through it. The valve assembly 50 is simply representative of a number of different methods to accomplish unidirectional flow through the baffle central opening.

For example, a hinged flapper valve 56, as shown in FIG. 2, on one end of the baffle would accomplish the same purpose.

Figure 6:
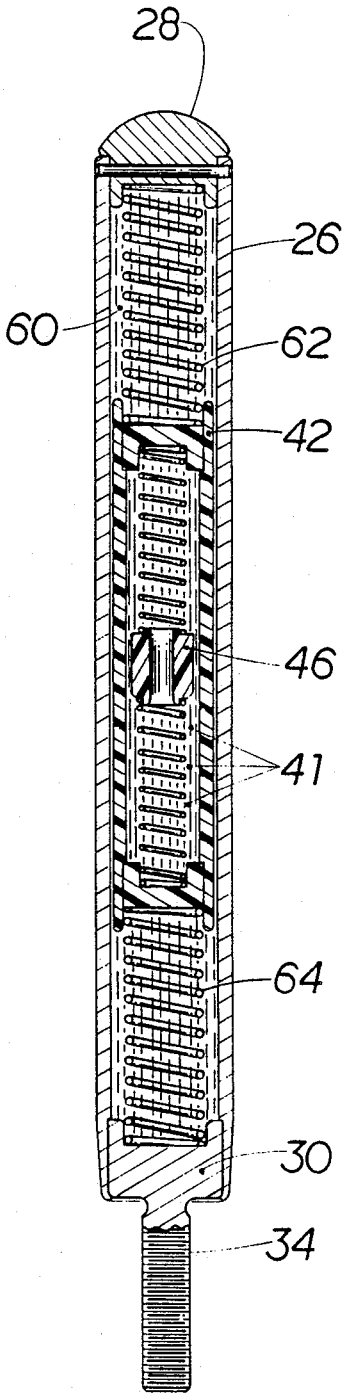
FIG. 6 is a partially sectioned view of a stabilizer in accordance with the present invention, showing an alternative embodiment as compared to the stabilizer embodiment illustrated in FIGS. 1–5.

FIG. 6 shows an alternative embodiment of the present invention wherein the casing 42 occupies approximately one-half the length of the housing cylinder 26 and has an outside diameter sufficiently less than the inside diameter of the cylinder 26 to enable it to slide longitudinally within the cylinder. In an area 60 of the housing, which constitutes the space at each end of the casing 42, a means is provided to cushion movement of the casing 42 in the form of forward end and rearward end compression springs 62 and 64. As shown, this embodiment of the invention requires that provision be made for locating and maintaining the springs in position, which can be annular integral ridges provided on the inside surface of the end cap 28, the plug 30, and the opposite ends of the casing 42, creating respective sockets for the spring ends.

FIG. 6 also illustrates that the casing 42 is preferably provided with a flow control means, here in the form of one of the baffles 46. Also carried within the casing 42 is the mercury 41 in an amount proportionate to the available internal area whereby shifting or flow of the mercury can occur along the length of the casing chamber in the same manner as heretofore described with reference to the earlier described embodiment. As with the earlier described embodiment in FIGS. 1 and 2, FIG. 6 shows the baffle 46 is longitudinally slidable within the chamber a limited distance. The baffle has forward and rearward compression springs for normally maintaining it in the location shown and for returning it to that position following any longitudinal sliding motion imparted to it during use of the stabilizer.

In the FIG. 6 embodiment, the sliding action of the casing 42 relative to the housing cylinder 26, and its vibration and thrust absorption effect during use of the stabilizer on an archery bow, can be further influenced by providing a viscous liquid which does not occupy the full area whereby it, too, can be temporarily displaced from its normal position in unison with the sliding action of the casing 42.

The foregoing structure for a bow stabilizer, in the several forms shown, presents a means of gradually and uniformly dissipating the energy transferred to the bow during use whereby the effects of thrust, torque, and vibration are significantly reduced. Such damping action enhances shooter control and accuracy to a remarkable degree.

The invention as disclosed is by the way of illustration and not limitation, and may be subject to modification all within the spirit and scope thereof.

I claim:

1. A stabilizer for an archery bow, comprising:

an elongated casing defining a central chamber;

means at one end of the casing for mounting the stabilizer to project forwardly from the bow at an angle substantially normal to the bow string;

the central chamber extending from immediately adjacent the mounting means and along the entire length of the casing;

a high density fluid in the chamber occupying the chamber's full length but less than the chamber's full space whereby the fluid is inertially responsive to shifting;

flow restricting means in the chamber for restricting fluid shifting in one longitudinal direction to a rate substantially less than the rate of fluid shifting in the other longitudinal direction; and the flow restricting means including a baffle located generally intermediate the length of the casing.

2. The stabilizer of claim 1 wherein the fluid within the chamber occupies between 80 and 90 percent of the chamber's volume.

3. The stabilizer of claim 1 wherein the chamber is tubular and the flow restrictor comprises a cylindrical member with an axial through-bore.

4. The stabilizer of claim 3 wherein the cylindrical member is adapted to shift longitudinally a limited distance along the chamber's axis.

5. The stabilizer of claim 3 further comprising biasing means in the chamber acting to normally retain the cylindrical member in a predetermined position.

6. The stabilizer of claim 5 wherein the biasing means comprises a plurality of compression springs.

7. The stabilizer of claim 5 wherein the biasing means comprises a compression spring between the cylindrical member and an end of the chamber.

8. The stabilizer of claim 1 wherein the flowable material is mercury, the flow restricting means is a plurality of spaced-apart baffles, and each baffle is a sleeve-like member adapted to permit the flow of the mercury in the casing in opposite directions, and further comprising means on each baffle for restricting the mercury flow in one direction.

9. The stabilizer of claim 8 wherein the means on each baffle for restricting the mercury flow is a valve on the baffle which opens for flow in one direction and closes to prevent return flow.

10. A stabilizer for an archery bow, comprising:

an elongated housing;

an elongated casing slidably supported within the housing and defining a central chamber;

means adjacent one end of the housing for mounting the stabilizer to project forwardly from a bow at an angle substantially normal to the bow string;

mercury contained in the chamber and occupying less than the chamber's space whereby the mercury is inertially responsive to shifting;

flow restricting means within the chamber for retarding the rate of the mercury shift; and means in the housing for cushioning the sliding action of the casing therein.

11. The stabilizer of claim 10 wherein the casing is generally centrally located relative to the length of the housing, and the area in the housing adjacent the casing contains a liquid occupying less than the available space in the housing.

* * * * *